US006435194B1

(12) United States Patent
Babay

(10) Patent No.: US 6,435,194 B1
(45) Date of Patent: Aug. 20, 2002

(54) DECORATIVE ECONOMICAL REVERSIBLE FASHION ACCESSORY

(76) Inventor: Daphne K. Babay, 822 Baucom Deese Rd., Monroe, NC (US) 28110

( * ) Notice: Subject to any disclaimer, the term of this patent is extended or adjusted under 35 U.S.C. 154(b) by 0 days.

(21) Appl. No.: 09/767,622

(22) Filed: Jan. 22, 2001

Related U.S. Application Data

(60) Provisional application No. 60/221,975, filed on Jul. 31, 2000.

(51) Int. Cl.[7] ..... A45D 8/12; A45D 8/04; A42B 19/02

(52) U.S. Cl. ..... 132/275; 132/273; 2/171

(58) Field of Search ..... 132/275, 273, 132/274; D28/41, 39; 119/850, 809; 2/171, 174

(56) References Cited

U.S. PATENT DOCUMENTS 2,211,184 A * 8/1940 Varell ..... 132/275
D205,829 S * 9/1966 Gettinger ..... D28/41
3,968,792 A * 7/1976 Small ..... 132/132
5,472,003 A * 12/1995 Frame et al. ..... 132/275
5,690,128 A * 11/1997 Grimes ..... 132/128
6,115,843 A * 9/2000 Travalgia ..... 2/171

* cited by examiner

*Primary Examiner*—John J. Wilson
*Assistant Examiner*—Robyn Kieu Doan
(74) *Attorney, Agent, or Firm*—Robert Nathans

(57) ABSTRACT

An economical reversible pony tail hair holder is disclosed, having a sleeve made of first and second bunched fabrics and having elastic bands sewed within opposite end portions of the sleeve to render it elasticized so that it tends to grip the pony tail. At any one time the outer fabric displays a first decorative design and upon the reversible sleeve being turned inside out, the inner fabric becomes the outer fabric to display a second different design.

8 Claims, 1 Drawing Sheet

DECORATIVE ECONOMICAL REVERSIBLE FASHION ACCESSORY

CROSS REFERENCE TO RELATED APPLICATIONS

The present invention is the subject of a provisional application filed Jul. 31, 2000, application Ser. No. 60/221,975.

BACKGROUND OF THE INVENTION

The present invention relates to the field of decorative fashion accessories.

As indicated in U.S. Pat. No. 5,413,126 to Revson, decorative fashion accesories such as pony tail hair holders are known in the art and which include elastic bands coupled to bunched fabric surrounding the pony tail. Other decorative pony tail holders are disclosed in U.S. Pat. No. 5,301,696 also issued to Revson; U.S. Pat. No. Des. 402,082 issued to Lee; U.S. Pat. No. 5,758,671 to Thim and U.S. Pat. No. 5,156,171 to Goodman.

It is deemed desirable to provide a pony tail holder to keep ones hair neat and out of the way while simultaneously giving, color, style, fashion and personality to one's overall appearance. Additionally, it is desirable to provide a pony tail holder which is easy to manufacture and is economical, since a single hair holder can display two different decorative designs. This concept appears to be absent in the prior art which is relatively crowded.

BRIEF SUMMARY OF A PREFERRED EMBODIMENT OF THE INVENTION

The decorative, reversible fashion accessory, most preferably a pony-tail hair holder, fastener or clasp, has a bunched stretchable sleeve made of a first textile-like material having a first design thereon and a second textile-like material having a second design thereon different from the first design, the first and second materials having first and second elastic member retaining portions at opposite sleeve ends respectively, for containing elasticized threads that cause the sleeve to tend to adhere to the body part, whereby the sleeve acts as a pony tail hair fastener retaining member. The first design is visible when the first material is on the outside of the reversible sleeve, and the second design is visible when the second material is on the outside of the sleeve upon turning the sleeve inside out.

BRIEF DESCRIPTION OF THE DRAWINGS

The various features of the invention will become more apparent upon reading the following detailed description taken in conjunction with the drawings in which.

DETAILED DESCRIPTION OF PREFERRED EMBODIMENTS OF THE INVENTION

Figure 1:
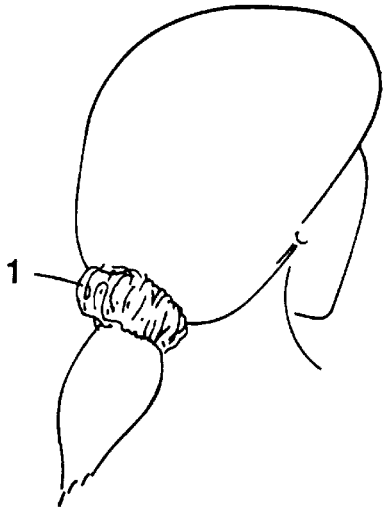
Figure 1 (PRIOR ART)
FIGS. 1 and 2 illustrate a prior art pony tail hair fastener.
Figure 2:
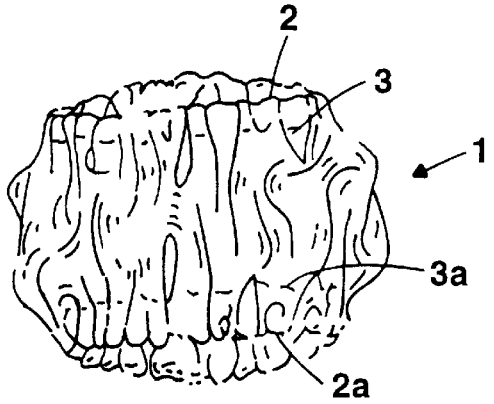
Figure 2 (PRIOR ART)

In FIG. 1, an elasticized pony tail hair holder 1 of the prior art is shown, affixed to a person's hair. A side view of the prior art hair holder 1 is illustrated in FIG. 2, that shows a top edge portion 2 and a bottom edge portion 2*a* enclosing adjacent elasticized threads 3 and 3*a* respectively. The elasticized threads tend to hold the stretchable hair holder or fastener in place upon the pony tail.

Figure 3:
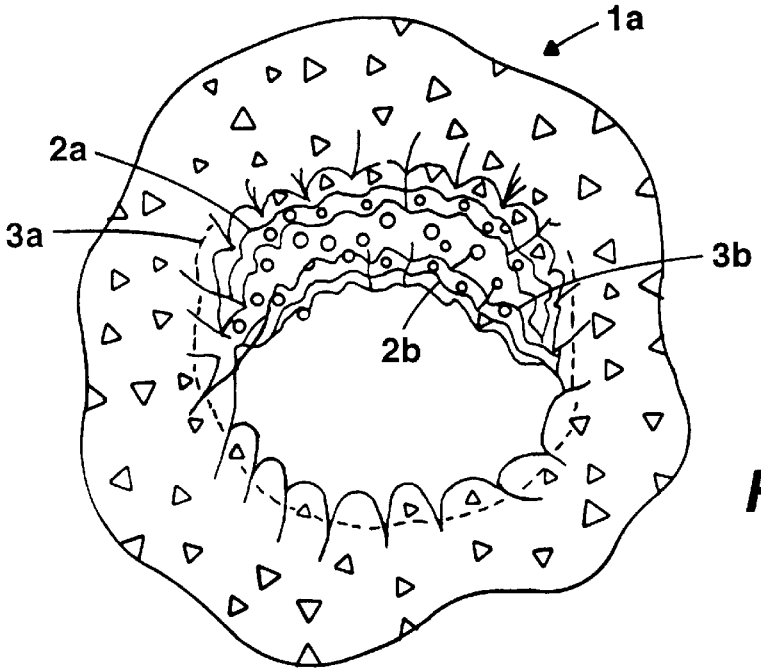
FIG. 3 illustrates a preferred reversible hair fastener of the present invention.

Referring now to a preferred embodiment of the present invention of FIG. 3, a stretchable sleeve 1*a* is shown made of a first bunched material having a first design thereon and a second bunched material having a second design thereon, different from the first design, the first and second materials having first and second elastic member retaining edge portions which can be formed by stiching the materials together by stitches at 2*a* and 2*b*.

The first and second edge portions at opposite ends of the bunched sleeve la contain elastic members preferably elasticized threads 3*a* and 3*b*, for causing the sleeve to tend to adhere to the pony tail. If appropriate, the sleeve is twisted into a "figure eight" to cause it to snugly fit about the pony tail as explained in the abstract of Revlon U.S. Pat. No. 5,301,696.

As shown in FIG. 3, a first "triangle" design is visible when said first material is on the outside of the sleeve. When it is desired to display the inner "circle" design when the sleeve is mounted upon the pony tail, the reversible sleeve is turned inside out by the wearer, before being affixed to the pony tail, and the second "circle" design is now visible as it is now on the outside of the sleeve after turning said sleeve inside out. Thus, a single hair holder functions as two decorative hair holders, and yet the manufacturing cost is virtually the same as the prior art hair holder.

The decorative possibilities of the decorative patterns are numerous. For example, one pattern could be green for Saint Patrick's day, and red white and blue for the fourth of July. An Italian flag pattern could be displayed for an Italian-American social event, and the American flag pattern could be displayed for the fourth of July holiday.

The skilled worker in the art will appreciate variations in the foregoing components and steps and thus the scope of the invention is to be restricted solely by the terms of the following claims and art recognized equivalents thereof. The aforesaid method of the present invention may be employed by mounting the sleeve upon the wrist or ankle of the wearer rather than upon the pony tail.

What is claimed is:

1. A decorative reversible fashion pony tail hair holder consisting essentially of:

(a) a single sleeve made of a first material having a first design thereon and a second material overlapping said first materials and having a second design thereon different from said first design, said first and second materials having first and second elastic member retaining means at fir and second opposite single sleeve ends respectively;

(b) first and second elastic members positioned within said first an second elastic member retaining means respectively for causing said sleeve to tend to adhere to said body part; and (c) wherein said first design is visible when said first material is on the outside of said sleeve and said second design is visible when said second material is on the outside of said sleeve upon turning said sleeve inside out.

2. The accessory of claim 1 wherein said elastic member retaining means are formed by stitching together said first and second materials at opposite sleeve ends, for containing said elastic members.

3. The accessory of claim 1 wherein said first and second designs are selected from the group consisting essentially of different patterns, colors, textures, materials, logos and national flags.

4. The accessory of claim 2 wherein said first and second designs are selected tom the group consisting essentially of different patterns, colors, textures, materials, logos and national flags.

5. A decorative reversible fashion pony tail hair holder comprising:

(a) a single sleeve dimensioned to be readily turned inside out and made of a first material having a first design thereon and a second material overlapping said first material and having a second design thereon different from said first design, said first and second materials having first and second means for joining said first and second material together;

(b) means for causing said sleeve to tend to adhere to said pony tail hair; and (c) wherein said first design is visible when said first material is on the outside of said sleeve and said second design is visible when said second material is on the outside of said sleeve upon turning said sleeve inside out.

6. The accessory of claim 5 wherein said first and second designs are selected from the group consisting essentially of different patterns, colors textures, materials, logos and national flags.

7. A method of employing an economical reversible decorative fashion accessory for being worn over a body part and usefull as a pony tail holder, arm or leg bracelet or the like comprising the steps of;

(a) providing a single sleeve dimensioned to be readily turned inside out and made of a first material having a first design thereon and a second material overlapping said first material and having a second design thereon different from said first design, said first and second materials having first and second means at opposite single sleeve ends for joining said first and second material together while causing said sleeve to tend to adhere to said pony tail hair, and wherein said first design is visible when said first material is on the outside of said sleeve and said second design is visible when said second material is on the outside of said sleeve upon turning said sleeve inside out;

(b) positioning said sleeve over said body part for causing said first design to be on the outside of said sleeve and visible; and (c) turning said sleeve inside out and repeating step (b) except that said second design is now on the outside of said sleeve and visible.

8. The method of claim 7 including providing a plurality of said fashion accessories, enabling different designs to be displayed for at least most days of the week.

* * * * *